US007937862B2

(12) United States Patent
Sato et al.

(10) Patent No.: US 7,937,862 B2
(45) Date of Patent: May 10, 2011

(54) SLIDING ACCESSORY METHOD

(75) Inventors: Jay K. Sato, Mission Viejo, CA (US); Mary Beth L. Chin, Wailuku, HI (US)

(73) Assignee: Avery Dennison Corporation, Pasadena, CA (US)

( * ) Notice: Subject to any disclaimer, the term of this patent is extended or adjusted under 35 U.S.C. 154(b) by 693 days.

(21) Appl. No.: 11/381,113

(22) Filed: May 1, 2006

(65) Prior Publication Data

US 2007/0019053 A1 Jan. 25, 2007

Related U.S. Application Data

(63) Continuation of application No. 10/321,220, filed on Dec. 16, 2002, now abandoned, which is a continuation-in-part of application No. 09/952,929, filed on Sep. 15, 2001, now Pat. No. 6,594,933.

(51) Int. Cl.
*B42F 21/00* (2006.01)

(52) U.S. Cl. ..... 40/359; 40/641

(58) Field of Classification Search ..... 40/359, 40/361, 641; 402/79; D19/99; 229/67.2
See application file for complete search history.

(56) References Cited

U.S. PATENT DOCUMENTS

| | | | | |
|---|---|---|---|---|
| 3,263,688 | A | 8/1966 | Anders | |
| 3,314,529 | A | 4/1967 | Glowiak | |
| 3,438,143 | A | 4/1969 | Wolfersberger, Jr. | |
| 3,444,635 | A | 5/1969 | Setzler | |
| 3,473,827 | A | 10/1969 | Leadbetter | |
| 4,318,236 | A * | 3/1982 | Giulini | 40/360 |
| 4,951,408 | A | 8/1990 | Banks | |
| 4,962,603 | A | 10/1990 | Kao et al. | |
| 4,972,615 | A | 11/1990 | Grant | |
| 5,182,152 | A | 1/1993 | Ericson | |
| 5,311,685 | A * | 5/1994 | Wyant | 40/359 |
| 5,462,783 | A | 10/1995 | Esselmann | |
| 5,662,976 | A | 9/1997 | Popat et al. | |
| 5,924,227 | A | 7/1999 | Sommers | |
| 6,013,154 | A | 1/2000 | Thomas-Cote | |
| 6,086,107 | A | 7/2000 | Whistler et al. | |

(Continued)

FOREIGN PATENT DOCUMENTS

| | | |
|---|---|---|
| GB | 1242619 | 8/1971 |
| GB | 2006683 | 5/1979 |

OTHER PUBLICATIONS

International Search Report dated Mar. 6, 2003 from related International Application No. PCT/US2002/29400.

(Continued)

*Primary Examiner* — Joanne Silbermann

(57) ABSTRACT

A sliding accessory may be mounted on a rail of a file folder, binder, sheet protector, divider, or other device. The accessory may be initially provided on a printable sheet, and may be provided with one or more fold lines that enable the accessory to be folded into a desired configuration. The fold lines may also be used to form a male portion that may be inserted into the rail of the file folder for attaching the accessory to the file folder. The male portion may be provided on one or two sides of the accessory depending on a rail configuration of the file folder. The male portion may have securing portions that interconnect with securing edges of the rail of the file folder. The securing portions and securing edges interconnect in such a manner that enables the accessory to be slidably moved along the rail. The accessory may be produced from a printable sheet having one or more die-cut accessories formed therein.

17 Claims, 14 Drawing Sheets

U.S. PATENT DOCUMENTS

| | | | | |
|---|---|---|---|---|
| 6,132,831 | A | 10/2000 | Thomas-Cote | |
| 6,284,338 | B1 * | 9/2001 | Bauman et al. | 428/42.3 |
| 6,332,285 | B1 | 12/2001 | Aaldenberg et al. | |
| 6,594,933 | B2 * | 7/2003 | Attia et al. | 40/641 |

OTHER PUBLICATIONS

International Preliminary Exam Report dated May 5, 2004 from related International Application No. PCT/US2002/29400.

* cited by examiner

SLIDING ACCESSORY METHOD

RELATED APPLICATIONS

This is a continuation of U.S. patent application Ser. No. 10/321,220, which was filed on Dec. 16, 2002, now abandoned, which is a continuation-in-part of Ser. No. 09/952,929 U.S. Pat. No. 6,594,933, filed on Sep. 15, 2001, the contents of which are hereby incorporated by reference herein in their entireties.

FIELD OF THE INVENTION

The invention relates to file folders, and to other systems that utilize or that could utilize a movable accessory system along an edge thereof, such as dividers, sheet protectors, folders, report covers, binders, folios, books, bound documents, and the like.

BACKGROUND OF THE INVENTION

Hanging file folders having movable tabs are known. The folders enable a user to position the tab along a portion of the folder. Typically, the folder provides slits that receive tab wings for positioning the tab at various locations along the folder. The tab wings may extend from each side of the tab and be inserted into a slit located on each side of the tab. These folders, however, generally only allow positioning the tab at fixed locations along the folder. Using slits to position the tab is often burdensome. For example, if a user desires to move a tab to a different location along the folder, the user must manually detach the tab, move the tab to a desired location, and insert the tab wings into slits corresponding to the desired location.

The tabs are also typically provided to a consumer without any indicia thereon. This enables the consumer to provide any desired information on the tab to facilitate distinguishing among a plurality of file folders. The consumer, however, typically must write the information by hand or use a typewriter. This is not efficient particularly if a plurality of tabs are to be provided with identical information. The consumer is also limited to information that may be provided on the tab by what type of information can be inserted by hand or with a typewriter.

Similar limitations exist with respect to other types of sliding members that may be used in conjunction with a file folder or other document holding system.

SUMMARY OF THE INVENTION

One embodiment of the invention relates to a sliding accessory that may be mounted on a rail of a file folder or other support member. The accessory may be provided with one or more fold lines that enable the accessory to be folded into a desired configuration. The fold lines may also be used to form a male portion that may be inserted into the rail for attaching the accessory to the support member. The male portion may be provided on one or two sides of the accessory, depending on the configuration of the rail. The male portion may have securing portions that interconnect with securing edges of the rail. The securing portions and securing edges interconnect in such a manner that enables the accessory to be slidably moved along the rail.

The accessory may be produced from a printable sheet having one or more removable, die-cut accessories formed therein. The printable sheet may include a top sheet having an adhesive provided on one side of the top sheet. The adhesive may be provided with a release liner that prevents the adhesive from adhering to undesired materials. The release liner also enables the printable sheet to be inserted into a standard printer. In this manner, each die-cut accessory may be provided with indicia by the printer. Using a conventional word processor or other device, indicia may be input and formatted with the word processor for providing the indicia on the die-cut accessories. This facilitates providing a plurality of die-cut accessories with identical indicia, however, some or each die-cut accessory may also be provided with distinct indicia.

According to one embodiment of the invention, a compact disc, business card or other holder may be mounted on a rail of a support member, such as the edge of a file folder. The holder may be die-cut on a printable sheet. The printable sheet may include a top sheet having an adhesive applied thereto and a release liner provided on the adhesive.

Another embodiment of the invention relates to a sliding tab that may be mounted on a rail of a file folder or other support member. The tab may be provided with one or more fold lines that enable the tab to be folded into a desired configuration. The fold lines may also be used to form a male portion that may be inserted into the rail for attaching the tab to the support member. The male portion may be provided on one or two sides of the tab, depending on the configuration of the rail. The male portion may have securing portions that interconnect with securing edges of the rail. The securing portions and securing edges interconnect in such a manner that enables the tab to be slidably moved along the rail.

Various other features of the invention will become apparent from a review of the Detailed Description, the Drawings, and the Claims.

DETAILED DESCRIPTION OF THE PREFERRED EMBODIMENTS

Figure 1A:
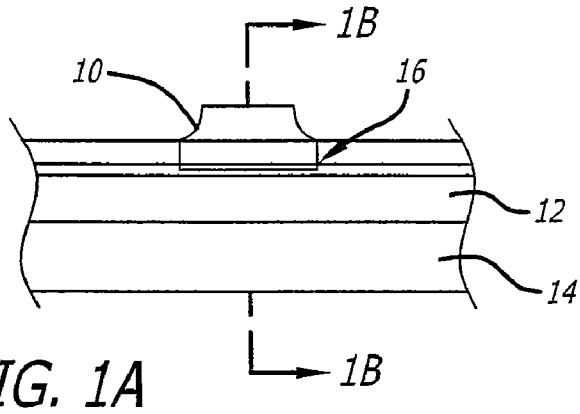
FIG. 1A is an illustration of a single edge, single rail file folder according to one embodiment of the invention.

FIG. 1A illustrates a sliding tab 10 mounted on a rail 12 of a file folder 14 according to one embodiment of the invention. The edge region of the file folder 14 forms a support member for the rail. The rail 12 may include a securing edge 16 that may be used to receive a portion of the sliding tab 10 for mounting the sliding tab 10 on the rail 12. The sliding tab 10 may be attached along one edge of one side of the file folder 14.

It is noted more generally that a wide variety of surfaces may form a support member, such as the edge of a file folder, a divider, a sheet protector, a folder, a report cover, a binder, a folio, a book, or a bound document, among others. The support member is typically a flat surface, although other surfaces can be utilized, such as arched or flexible surfaces.

Figure 1B:
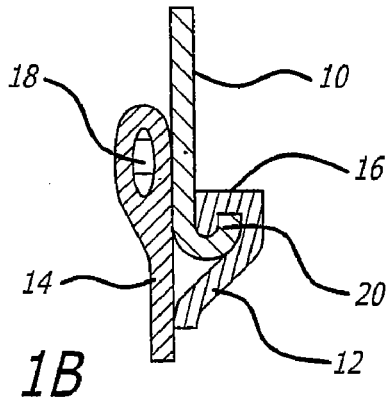
FIG. 1B is a cross-section view of FIG. 1A taken along Line 1B-1B.

FIG. 1B is a cross-section along lines 1B of FIG. 1A. As shown in FIG. 1B, the file folder 14 may include a metal hanger 18 as is known in the art. The tab 10 may include a securing portion 20 that may attach to the securing edge 16 for mounting the tab 10 to the rail 12. The securing portion 20 may include a U-shaped portion that is received within the rail 12 and secured by the securing edge 16. As shown in FIGS. 1A and 1B, the tab 10 may be secured to the file folder 14 according to a single edge, single rail embodiment. The tab 10 is secured to the file folder 14 such that the rail 12 retains the tab 10 but enables the tab 10 to be slidable along the rail 12. This may be achieved by providing the rail 12 with a configuration such that the securing edge 16 applies an amount of pressure on the securing portion 20, so that the tab 10 is retained on the rail 12, but is slidable along the rail.

Figure 2:
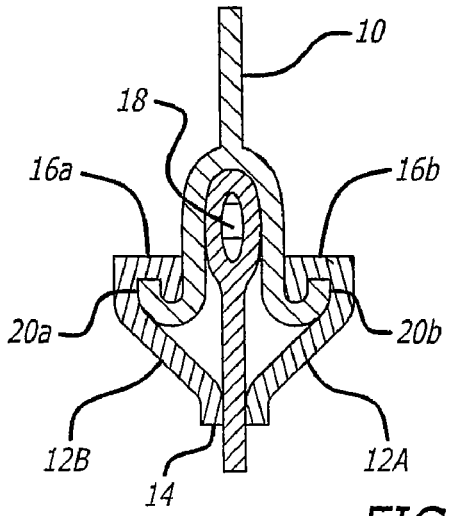
FIG. 2 is a cross-section view of a single edge, two rail sliding tab system mounted on a file folder according to one embodiment of the invention.

FIG. 2 illustrates a single edge, dual rail embodiment according to the invention. A file folder 14 may include two (2) rails 12A, 12B mounted on two (2) sides of the file folder 14. The rails 12A, 12B may include securing edges 16A, 16B, respectively. A tab 10 may be mounted on the folder 14 and include two (2) securing portions 20A, 20B. The securing portions 20A, 20B, may be mounted on both sides of a metal hanger 18 of the file folder 14. The securing portions 20A, 20B may include a U-shaped portion that attach to the securing edges 16A, 16B of the rails 12A, 12B. The single edge, dual rail embodiment shown in FIG. 2 may provide a more secure attachment of the tab 10 to the file folder 14 because a dual-sided securing mechanism is used, however, two (2) rails are required as opposed to a single rail as shown in FIG. 1B.

To attach the tab 10 to either the single rail embodiment as shown in FIG. 1B or the two (2) rail embodiment shown in FIG. 2, the rail 12 or rails 12A, 12B may be provided with open end on both sides such that the tab 10 may be inserted into the rail 12 or rails 12A, 12B at either end. Alternatively, the tab 10 may be secured to file folder 14 by inserting the tab 10 parallel to the rail or rails from the direction of the top edge of the folder.

Figure 3A:
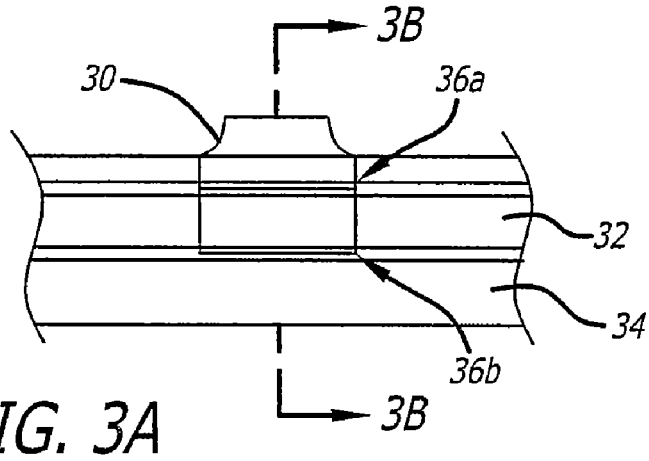
FIG. 3A is an illustration of a two edge, single rail sliding tab system mounted on a file folder according to one embodiment of the invention.
Figure 3B:
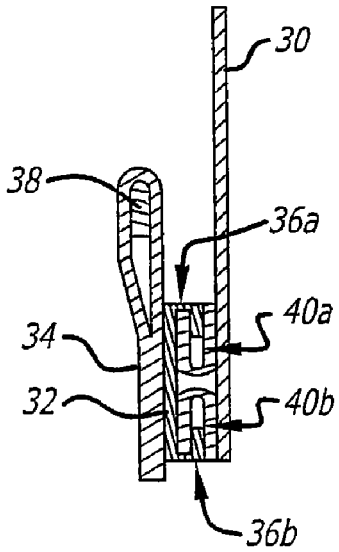
FIG. 3B is a cross-section view of FIG. 3A.

FIG. 3A illustrates a two (2) edge, single rail embodiment for securing a sliding tab 30 to a rail 32 of a file folder 34 according to the invention. The rail 32 may include securing edges 36A, 36B for mounting the tab 30 to the rail 32. FIG. 3B is a cross-section of FIG. 3A along lines 3B. FIG. 3B illustrates that the rail 32 of the file folder 34 may include an upper securing edge 36A and a lower securing edge 36B. The folder 34 may also include a metal hanger 38 as is known in the art. The tab 30 may include an upper securing portion 40A and a lower securing portion 40B. The securing portions 40A, 40B may be used to attach the tab 30 to the rail 32 by connecting to the securing edges 36A, 36B of the rail 32. The securing edges 36A, 36B of the rail 32 may each form a channel that receives a portion of the securing portions 40A, 40B of the tab 30. The rail 32 may include an open portion between the securing edges 36A, 36B that enables the securing portions 40A, 40B of the tab 30 to be inserted into the channels formed by the securing edges 36A, 36B. The tab 30 and the securing edges 36A, 36B are preferably formed of a substantially rigid material that enables the securing portions 40A, 40B to be inserted into the channels formed by the securing edges 36A, 36B and secured thereby.

Figure 4:
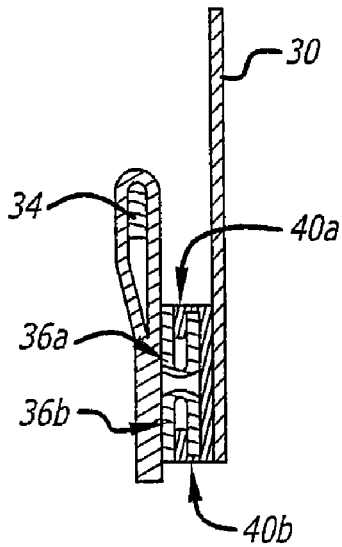
FIG. 4 is a cross-section view of a sliding tab system mounted on a file folder according to one embodiment of the invention.

The tab 30 may be formed from a rigid or substantially rigid material such as polyester or plastic although other types of material may be used. According to one embodiment, the tab 30 may be made from polyester having a thickness of about 6.5 mils. The tabs 30 may also be provided with securing portions that enable the tab 30 to be mounted to a rail of a file folder as described above. It is to be understood that many different combinations of materials for the tab 30 and the rail 32 may be used. As illustrated in FIG. 3B, the securing edges 36A, 36B may form a "C" shape and securing portions 40A, 40B may include U-shaped portions. FIG. 4 illustrates the opposite of FIG. 3B where the tab 30 includes "C" shaped securing portions 40A, 40B that attach to U-shaped securing edges 36A, 36B of the rail 32 attached to the folder 34.

The rails shown in FIGS. 1-4 are preferably constructed of a substantially non-pliable material such as polyester, or other material. According to one embodiment, the rails may be made of polyester having a thickness of about 6.5 mils. The material may be provided with an adhesive or other securing mechanism to enable the rail or rails to be attached to a file folder. For example, the rail or rails may be provided with wings or flaps that may be inserted into graduated slots provided on a file folder as is known in the art. The rails may also include a mechanism for aligning the rail on a folder such as, for example, a locking portion located on both ends of the rail that may be secured around each edge of the file folder. This may enable the rail to be mounted substantially parallel to the file folder. Alternatively, the file folders may be constructed with rails mounted thereon.

Figure 5A:
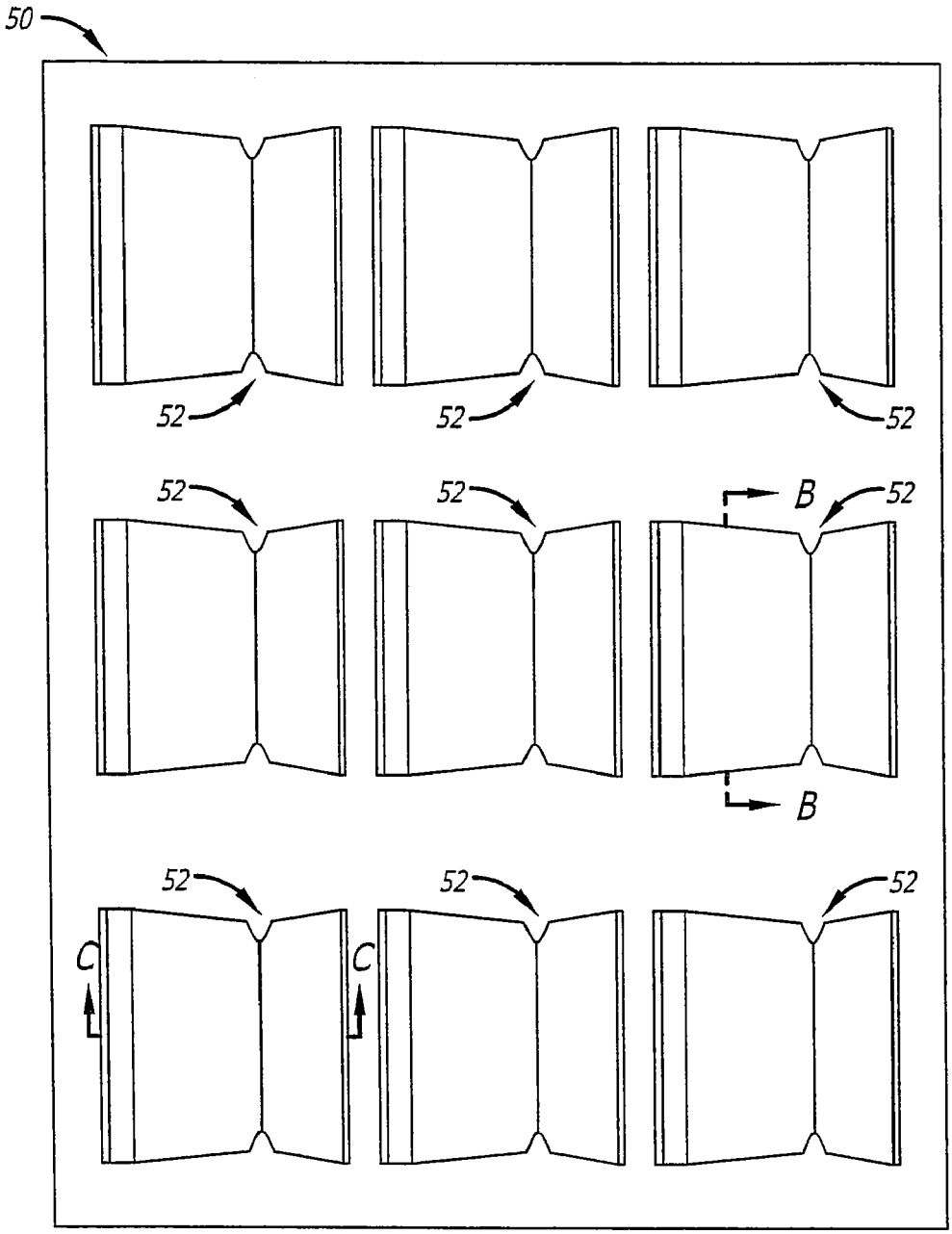
FIG. 5A is an illustration of a printable sheet having die-cut tabs according to one embodiment of the invention.
Figure 5B:
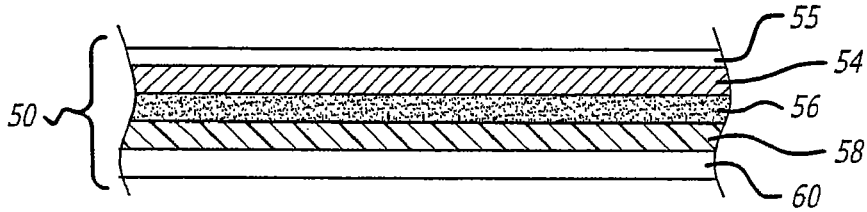
FIG. 5B is a cross-section of a printable sheet having die-cut tabs according to one embodiment of the invention, taken along Line 5B-5B.

FIG. 5A illustrates a printable sheet 50 having a plurality of die-cut tabs 52. FIG. 5B illustrates a cross-section of the printable sheet 50 along Line 5B-5B of FIG. 5A according to one embodiment of the invention. The printable sheet 50 may include a polyester top sheet 54. The top sheet may be coated with a print-receptive coating 55, such as an inkjet printable coating or a laser printable coating. Such coatings are known in the art. A pressure sensitive adhesive 56 may be applied to one side of the polyester top sheet 54. The pressure sensitive adhesive 56 may be used for securing a portion of the tab 52 to another portion of the tab 52. The release liner 60, which may include a silicone release coating 58, serves as a backing from which the tab assemblies may be removed. The release liner also prevents the adhesive from coming into contact with parts in the laser, ink jet or other printer in which the tab is printed.

Figure 5C:
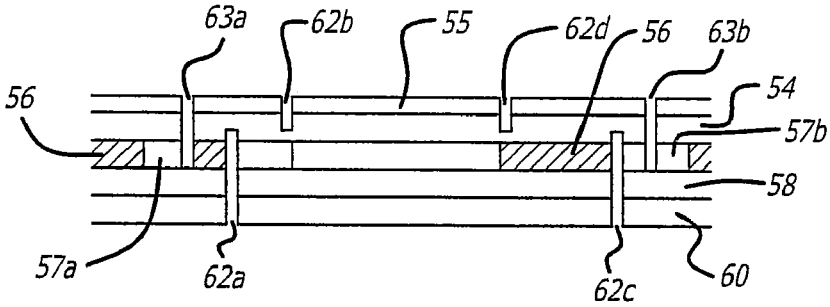
FIG. 5C is a cross-section of FIG. 5A taken along Line 5C-5C.

FIG. 5C is a cross-section taken about Line 5C-5C in FIG. 5A. FIG. 5C illustrates that the tabs are coated with adhesive in a pattern. The pattern includes adhesive free zones 57*a* and 57*b*. Other areas 56 are coated with adhesive. FIG. 5C also illustrates a pattern of full die cuts 63*a* and 63*b* that extend through the face sheet, and partial die cuts 62*b* and 62*d* that extend partially through the face sheet. Score lines 62*a* and 62*c* may extend through the release liner and partially through the face sheet. The score lines 62*a* and 62*c* and partial die cuts 62*b* and 62*d* provide means for accurately folding the tab. The cuts 62*b* and 62*d* may alternatively be perforations or other lines of weakness.

Figure 5D:
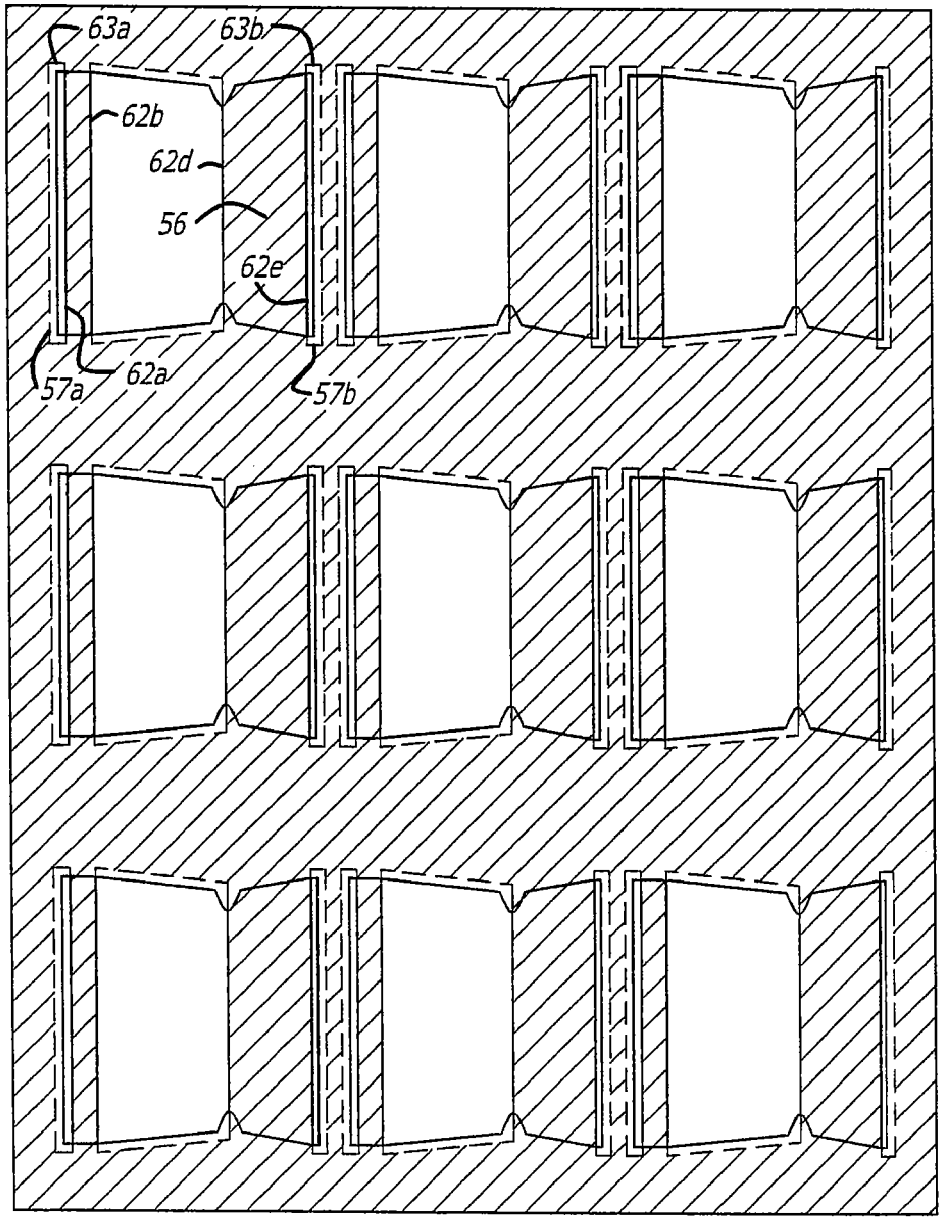
FIG. 5D illustrates the adhesive pattern on the back of the sheet of FIG. 5A.

FIG. 5D illustrates the adhesive pattern on the back of the face sheet of FIG. 5A. Certain areas of the sheet have no adhesive, while other areas are coated with adhesive.

Figure 6:
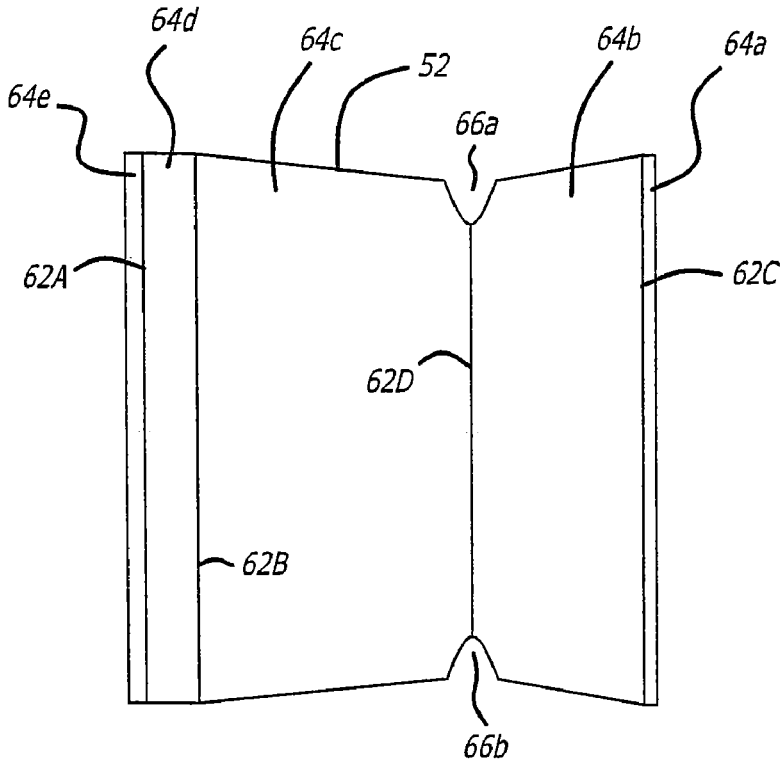
FIG. 6 is an illustration of a die-cut tab according to one embodiment of the invention.

FIG. 6 illustrates a die-cut tab member 52 after having been removed from the sheet 50 (FIG. 5A) according to one embodiment of the invention. The tab 52 may be formed by providing a complete die-cut through a top sheet of a printable sheet for providing a take-out line around the tab 52, thereby forming a tab member that is removable from the sheet. The tab 52 may also include one or more fold lines 62A-62D. The fold lines 62A-62D may be a partial, for example, half (½) depth, score cut through a top sheet of a printable sheet 50 as shown in FIG. 5C. The fold lines 62A-62D may be used to fold the tab into a desired shape and size for mounting on a file folder. The fold lines 62A-62C may be used to form securing edges that may be used to mount the tab 52 to a rail of a file folder described in further detail below. The tab 52 may also include indicia printed thereon for providing information on the tab 52.

The tab member 52 has several panels that are defined, in part, by fold lines. The panels are identified as reference numbers 64*a*-64*e* on FIG. 6.

Figure 7:
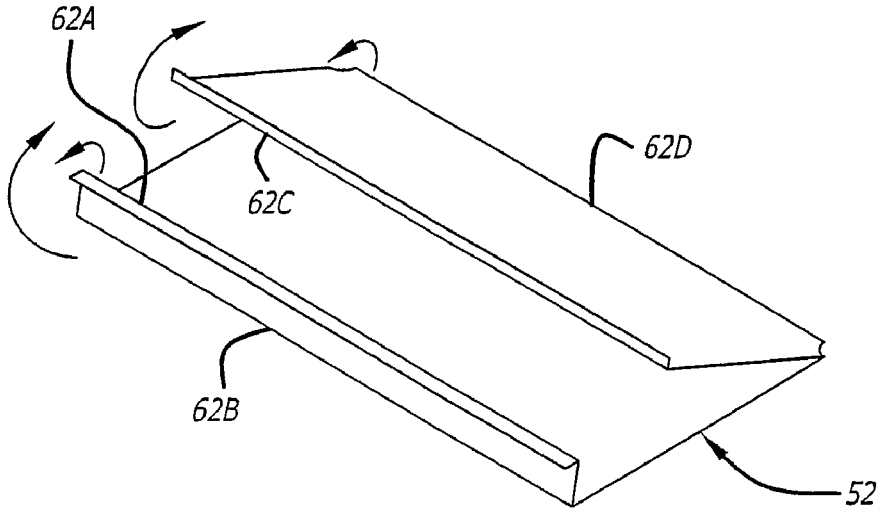
FIG. 7 illustrates a manner of folding a die-cut tab according to one embodiment of the invention.

FIG. 7 illustrates a method for folding the tab of FIG. 6 to form securing portions for mounting the tab on a rail of a file folder having a two edge, single rail embodiment according to the invention. The tab may be adhered together with pressure sensitive adhesive, heat-sensitive adhesive, water-activated adhesive, solvent-activated adhesive, or other adhesives and/or glues. The adhesive may be pre-applied in a pattern on the removable tab member 52. For example, the adhesive may be coated in a strip beginning at fold line 62*c* and moving in a distance into panel 64*b* and in a strip beginning at fold line 62*b* and moving in a distance into panel 64*d*. When the assembly is folded as in FIG. 7, the adhesive strip adheres to a portion of panel 64*c*.

Figure 8:
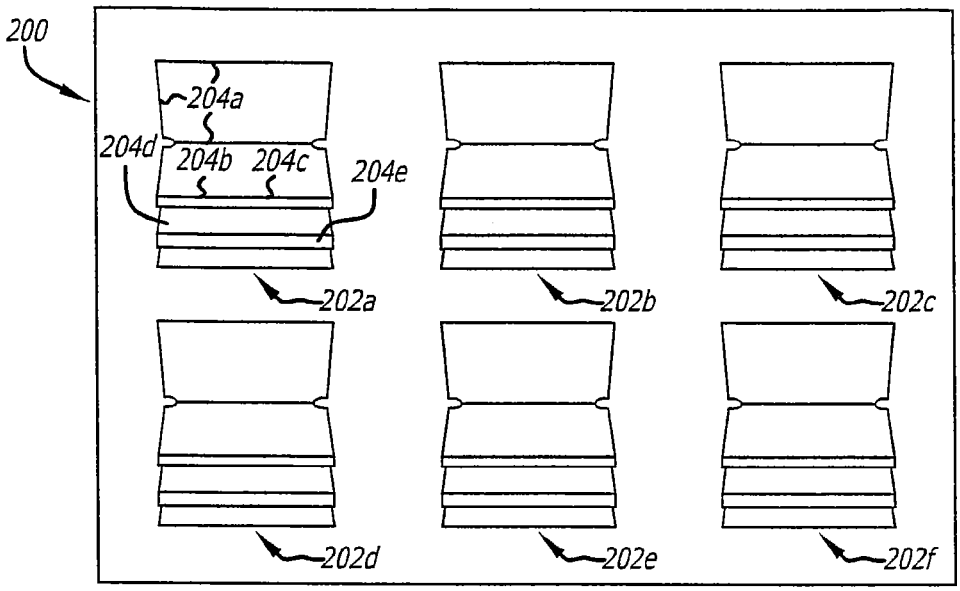
FIG. 8 illustrates an alternative sheet having a plurality of die cut tabs.

FIG. 8 illustrates a printable sheet 200 that includes die-cut tabs 202A-202N. The tabs 202A-202N may include fold lines 204A-204E such that the tab may be folded into a desired configuration and provided with a male portion for inserting into a rail of a file folder. Each tab 202A-202N may be provided with adhesive portions 206A, 206B (see FIG. 9) that facilitate maintaining the tabs 202A-202N in a desired configuration after folding along the fold lines 204A-204E. Any number of the tabs 202A-202N may be die-cut on the printable sheet 200 limited only by a size of the printable sheet 200 and a desired size of the tabs 202A-202N. According to one embodiment of the invention, the fold lines 204A-204E are half (½) cut score lines through the top sheet of the printable sheet 200. Each outline of tabs 202A-202N are preferably full cut tab outlines through the top sheet of the printable sheet 200. Preferably, the top sheet of printable sheet 200 is polyester having a thickness of about 6.5 mils.

Figure 9:
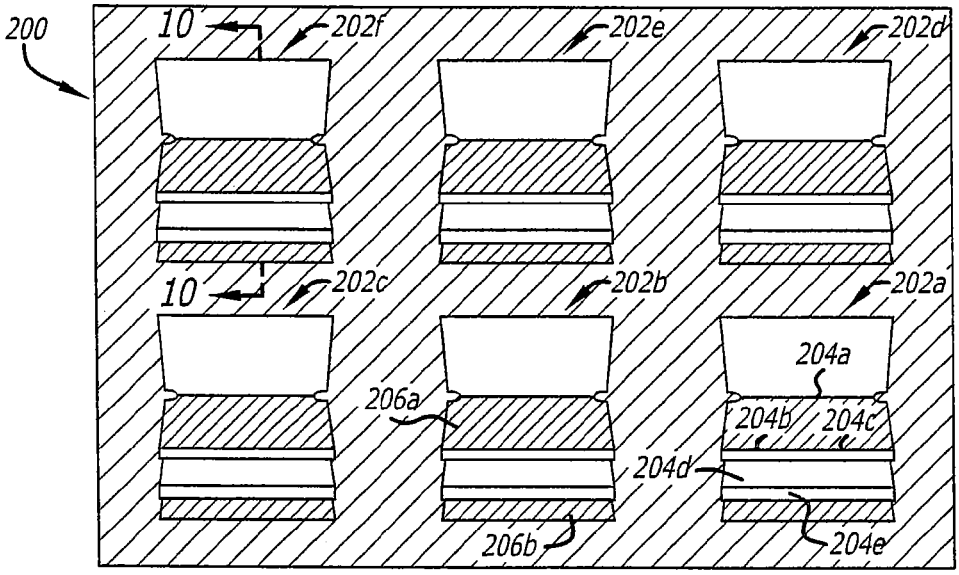
FIG. 9 illustrates an adhesive pattern that backs the sheet of FIG. 8.

FIG. 9 illustrates the adhesive backing on the printable sheet 200. The adhesive pattern includes areas that are coated with adhesive and other areas that are not coated with adhesive. The sheet includes die-cut tabs 202A-202N. Each die-cut tab 202A-202N may include a plurality of fold lines 204A-204E that enable the die-cut tabs 202A-202N to be folded into a desired shape and also formed with a male portion for inserting into a rail of a file folder. It is to be understood that any desired number of tabs 202A-202N may be used. A predetermined number of tabs 202A-202N may be limited depending only on a size of printable sheet 200 and a desired size of the die-cut tabs 202A-202N. The printable sheet 200 may be formed of materials as described with reference to the printable sheet 50.

Figure 10:
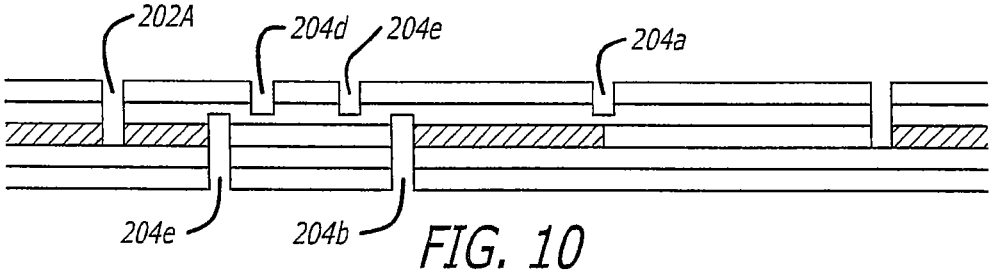
FIG. 10 is a cross-section taken across Line 10-10 of FIG. 9.

FIG. 10 illustrates a cross-section taken about Line 10-10 of FIG. 9. The sheet includes fold lines or score lines extending into the sheet to various extents. Some of the score lines such as 202*a*, 204*a, c* and *d* extend from the front inward while others, such as 204*b* and 204*e* extend from the back of the sheet inward.

Figure 11:
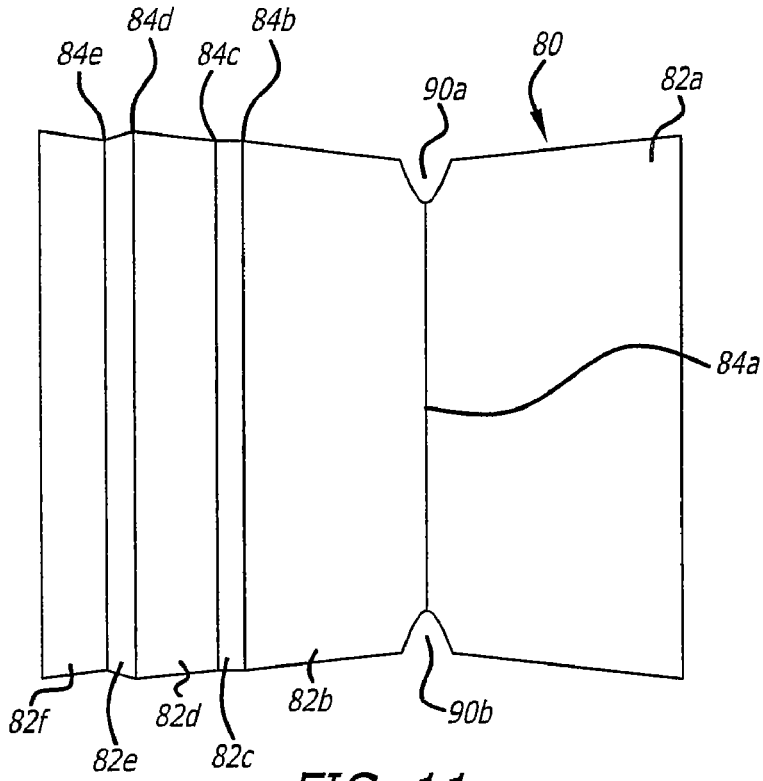
FIG. 11 is an illustration of a die-cut tab according to one embodiment of the invention.
Figure 12:
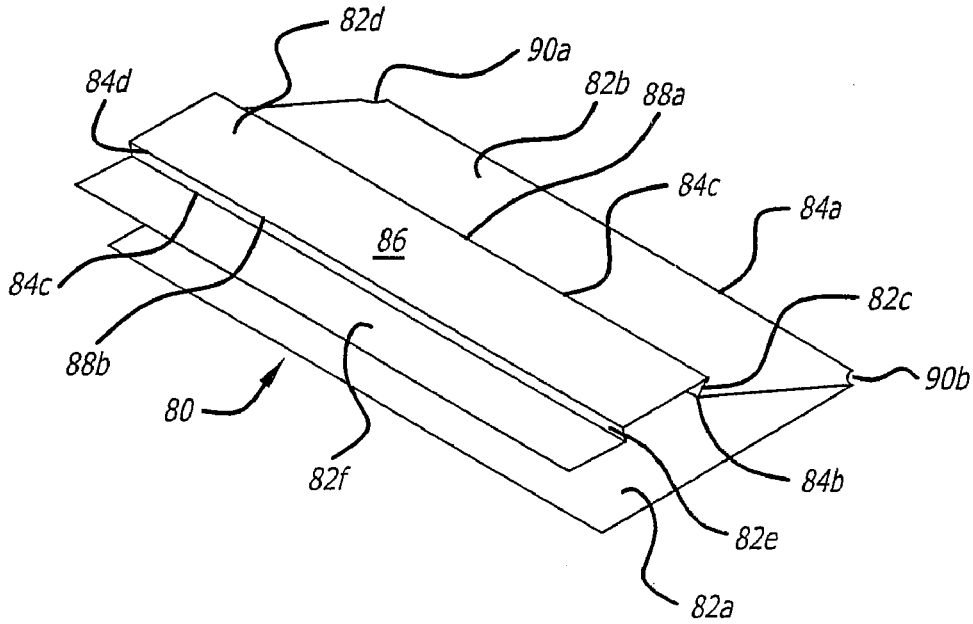
FIG. 12 is an illustration of a male portion of a die-cut tab after printing the tab and folding it, such that the male portion may be used for mounting the die-cut tab to a rail of a file folder according to one embodiment of the invention.

FIGS. 11 and 12 illustrate an alternative tab 80 that may be mounted on a rail of a file folder using a single rail embodiment. As shown in FIG. 11, the tab 80 may include panels 82*a*-82*f*. Fold lines 84*b*-84*e* may be used to form a securing portion that may be mounted on a rail of a file folder. Adhesive is applied to portions 82*b* and 82*f*, but typically not elsewhere on the tab.

As shown in FIG. 12, the fold lines 84*b*-84*e* may be used to form a male portion 86 that may be inserted into a rail of a file folder. The male portion 86 may include securing portions 88A, 88B that may be inserted into a rail of a file folder for securing the tab 80 with securing edges of the rail of the file folder.

Figure 13:
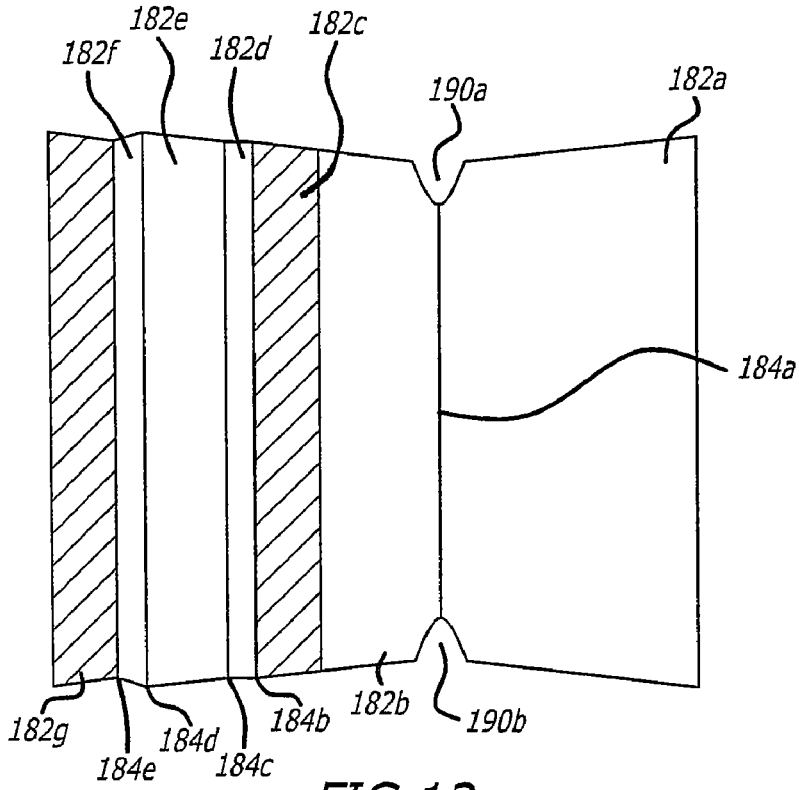
FIG. 13 is an illustration of a transparent tab after removal from the sheet assembly, showing an adhesive pattern that is coated on the back side of the tab.
Figure 14:
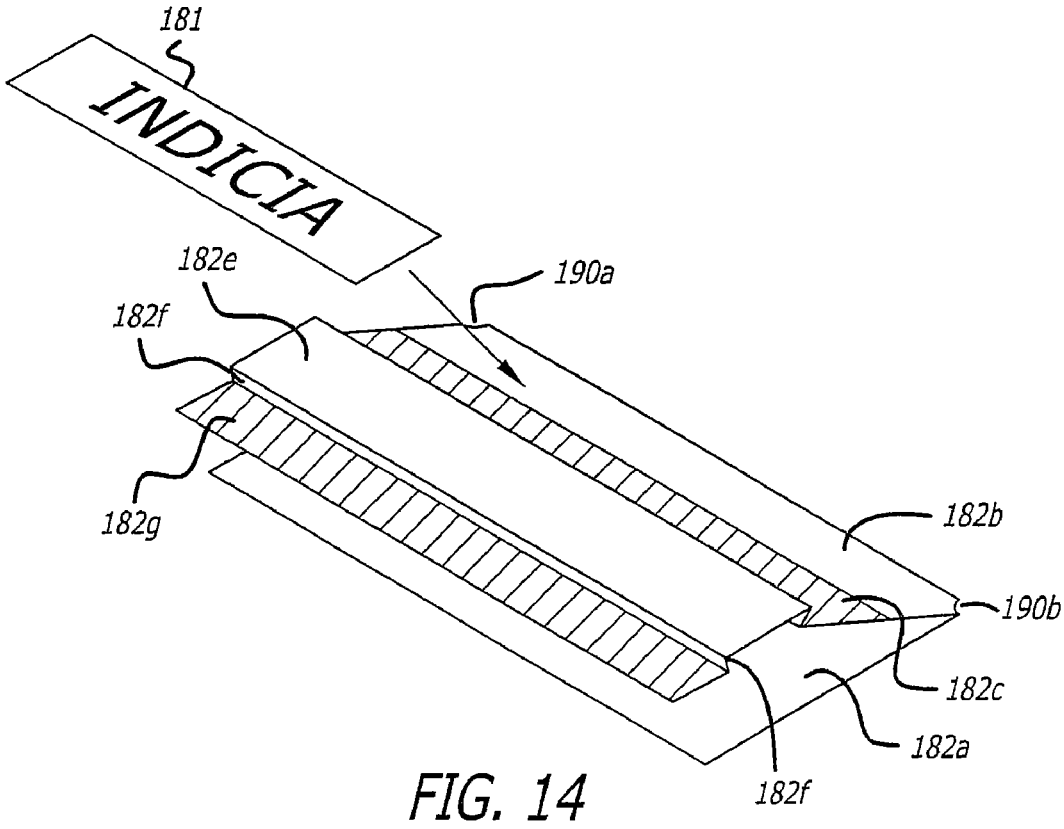
FIG. 14 is the transparent tab of FIG. 10 as it appears as it is being folded, just before portions of the tab are adhered together, and with an optional insert printed with indicia.

FIGS. 13 and 14 illustrate an embodiment of a tab construction of FIG. 11, but made from a substantially transparent material to reveal one suitable adhesive pattern. The tab has a top panel 182*a*, a bottom panel 182*b*, an engagement panel 182*d*, a support panel 182*e*, a second engagement panel 182*f*, and an end panel 182*g*. Panels 182*a* and 182*b* are separated by a partial die-cut or score line 184*a* that serves as a fold line. Similar fold lines are located at 184*c*-184*f*. An adhesive or glue is provided on the back of sections 182*c* and 182*g*. The adhesive is typically a permanent pressure sensitive adhesive known in the art. However, alternatively, a water, solvent or heat-activated glue or other adhesive or glue may be employed. Notches 190*a* and 190*b* are designed to allow for easy access to an insert card that may be inserted in the completely assembled tab.

FIG. 14 illustrates the flat tab assembly of FIG. 13 being folded into a tab. The adhesive-backed tab panel 182*g* is folded into contact with the panel 182*a*, typically such that the edge of the panel 182*g* matches the edge of panel 182*a*. Panels 182*d*-182*f* fold along respective score lines 184*c*-184*f* to form a male rail engagement portion. Panels 182*f* and 182*d* may angle inward, such that angles between panels 182*d* and 182*e* and between panels 182*f* and 182*e* are less than 90 degrees. This facilitates securely mounting the tab assembly onto the rail.

Because panel 182*a* is not backed with adhesive, an insert 191 may be slid in between panel 182*a* and panel 182*b*. For example, the insert may be pre-printed cardstock that the user slides in between panel 182*a* and bottom panel 182*b*. If 182*a* and/or 182*b* are a substantially transparent material, the printed portion of the insert may be visible. Alternatively, a surface of the tab assembly itself may be coated with a print-receptive coating as, for example, with an inkjet or laser-toner receptive coating. Indicia may then be printed directly onto the tab.

Figure 15:
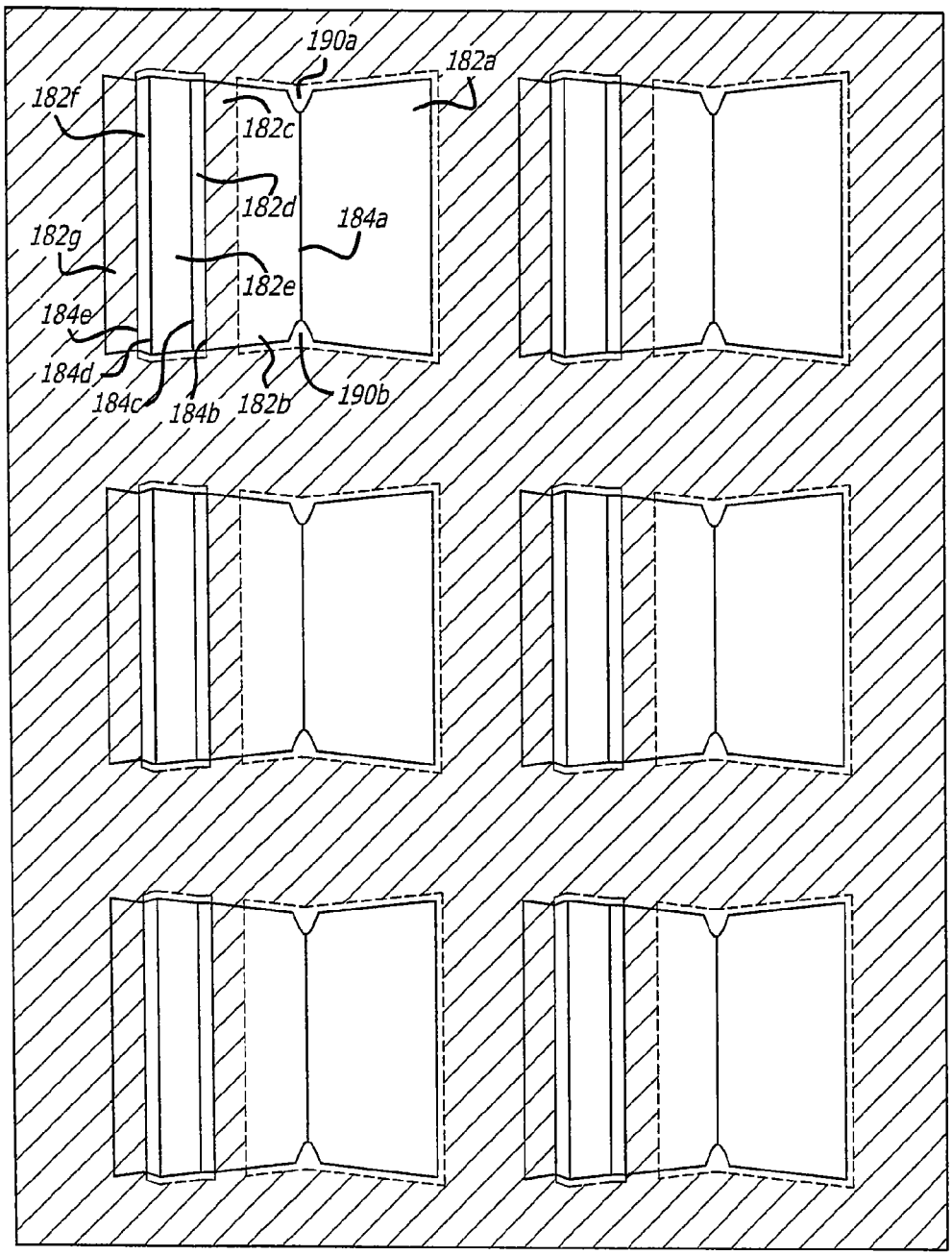
FIG. 15 is an illustration of the adhesive pattern that backs the printable face sheet of FIG. 13.

FIG. 15 illustrates the adhesive pattern that may be used on the back of a sheet to form the members of FIGS. 13 and 14. The adhesive pattern includes areas that are coated with adhesive, and other areas that are not coated with adhesive.

Figure 16A:
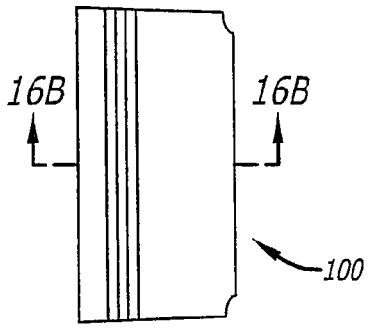
FIG. 16A is an illustration of a folded die-cut tab according to one embodiment of the invention.
Figure 16B:
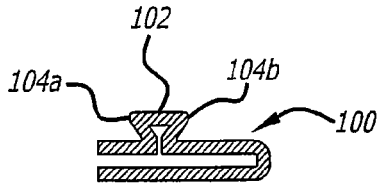
FIG. 16B is a cross-section of FIG. 12A taken along Line 12B-12B.

FIG. 16A illustrates a tab 100 folded to create a male portion for inserting into a rail of a file folder. FIG. 16B is a cross-section of FIG. 16A along lines 16B. FIG. 16B illustrates a tab 100 folded to create a male portion 102 having securing portions 104A, 104B. The male portion 102 of tab 100 may be inserted into a rail of a file folder and secured to the rail by mating securing portions 104A, 104B with securing edges of the rail of the file folder.

It should be understood that the fold lines, such as 184A-184F may be provided at various locations along the tab. Depending on a desired size of the male portion, the fold lines may be provided at various locations to provide a male portion 102 of a desired size.

Figure 17:
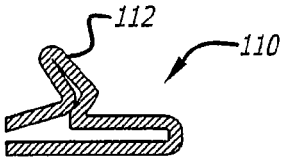
FIG. 17 is a cross section of a die-cut tab according to one embodiment of the invention.

FIG. 17 illustrates an alternative tab 110. The tab 110 may include a male portion 112 that may be used to secure the tab 110 to the securing edges of a rail of a file folder. The additional benefit of this tab construction is that it has generally wider panels compared with the constructions shown in FIGS. 6, 11, and 13. The wider panels make the tab easier to fold into its final configuration.

Figure 18:
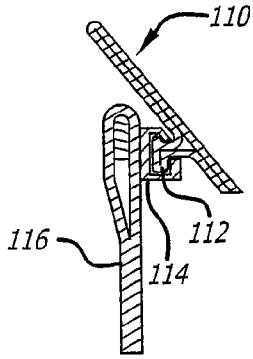
FIG. 18 is a cross section view of a slidable tab mounted on a file folder according to one embodiment of the invention.

FIG. 18 illustrates a tab member 110 having a male portion 112 secured to a rail 114 of a file folder 116. The rail 114 may include a substantially rectangular portion having an open portion through which the male portion 112 of the tab 110 may be inserted. The rail 114 may include multiple sides for retaining the male portion 112 within the rail 114.

Figure 19:
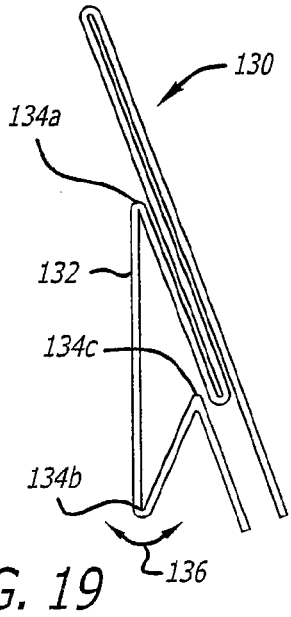
FIG. 19 is a cross-section view of a slidable tab that may be mounted to a rail of a file folder according to one embodiment of the invention.
Figure 20:
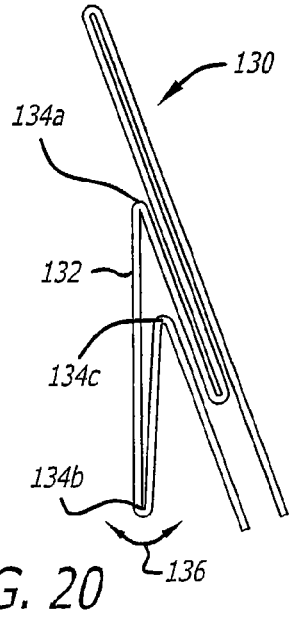
FIG. 20 is a cross-section view of a slidable tab that may be mounted to a rail of a file folder according to one embodiment of the invention.

FIG. 19 illustrates a tab member 130. The tab member 130 may include a male portion 132. The male portion 132 may include fold lines 134A, 134B, and 134C. The fold lines 134A-134C may enable the male portion 132 to be of a substantially triangular shape. Depending on how close fold line 134*c* gets to fold line 134*a*, the male portion 132 may facilitate or resist movement of the tab member 130 in a direction indicated by arrows 136. If fold line 134C is relatively far from fold line 134*a*, this resists movement of the tab member 130 along a direction indicated by the arrows 136. If, however, fold line 134*c* is relatively near to fold line 134*a*, this facilitates movement of the tab member 130 along the direction indicated by the arrows 136 as shown in FIG. 16. As shown in FIGS. 19 and 20, the fold lines 134A and 134B may form opposite ends of the male portion 132. The ends formed by the fold lines 134A and 134B may be inserted into a rail of a file folder for attaching the tab member 130 to the file folder. The ends formed by the fold lines 134A and 134B may be inserted into a rail of a file folder as shown in FIG. 18.

Figure 21:
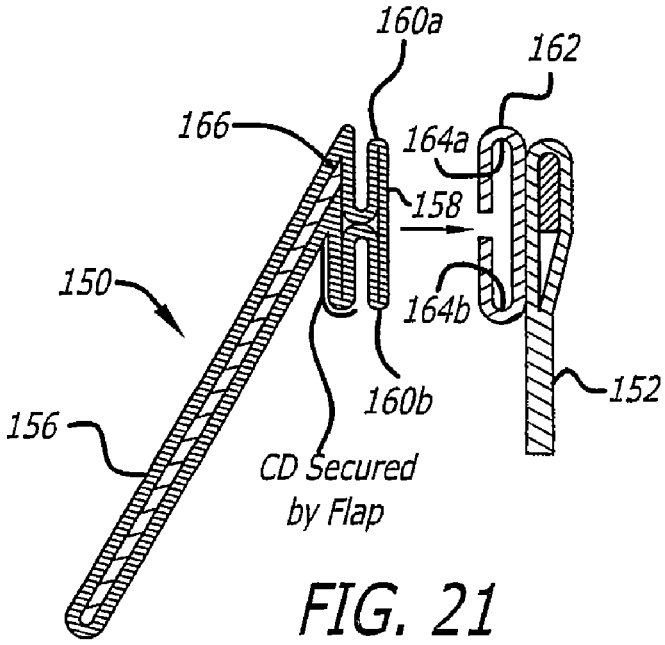
FIG. 21 is a side-view of an accessory that may be mounted to a rail of a file folder according to one embodiment of the invention.

FIG. 21 illustrates a cross-section view of a compact disc holder 150 and a file folder 152. The compact disc holder 150 may include a pocket opening 166 that receives a compact disc 156 or other item. The compact disc holder 150 may also include a male portion 158 that includes securing portions 160A, 160B. The securing portions 160A, 160B may be inserted into a rail 162 of the file folder 152. The rail 162 may include securing edges 164A, 164B. The securing portions 160A, 160B may interconnect with the securing edges 164A, 164B such that the compact disc holder 150 may be attached to the file folder 152 by rail 162. However, the compact disc holder 150 is preferably slidable along the rail 162.

Figure 22:
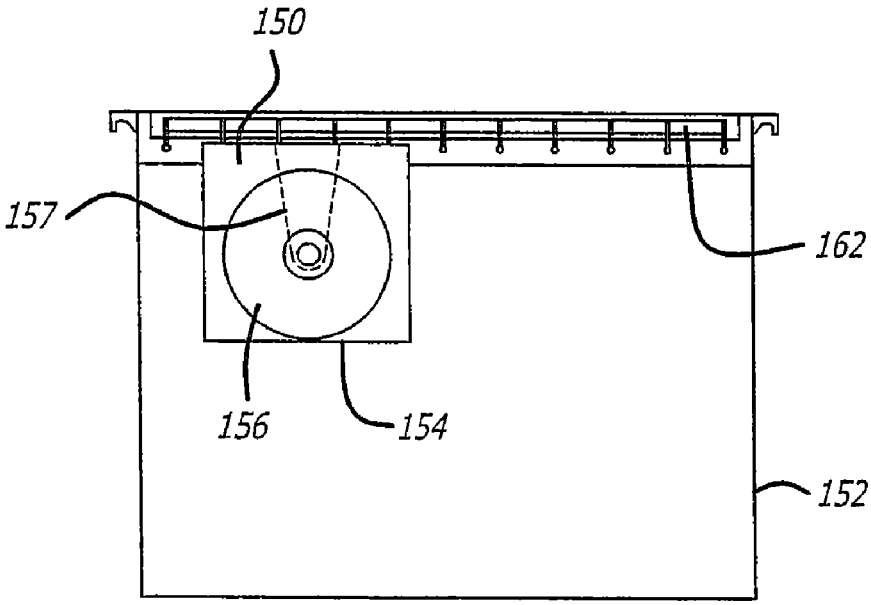
FIG. 22 is a front-view of a compact disk holder mounted to a rail of a file folder according to one embodiment of the invention.

FIG. 22 is a front view of a compact disc holder 150 attached to a file folder 152 by a rail 162. The compact disc holder 150 may be secured to the rail 162 by a male portion (shown in FIG. 21) that enables the compact disc holder 150 to be slidable along the rail. The compact disc holder 150 may also include a compact disc 156 located within a pocket 154. The pocket may include a cut-out 157 on the side of the pocket adjacent to the folder, for aiding in accessing the compact disc.

Figure 23:
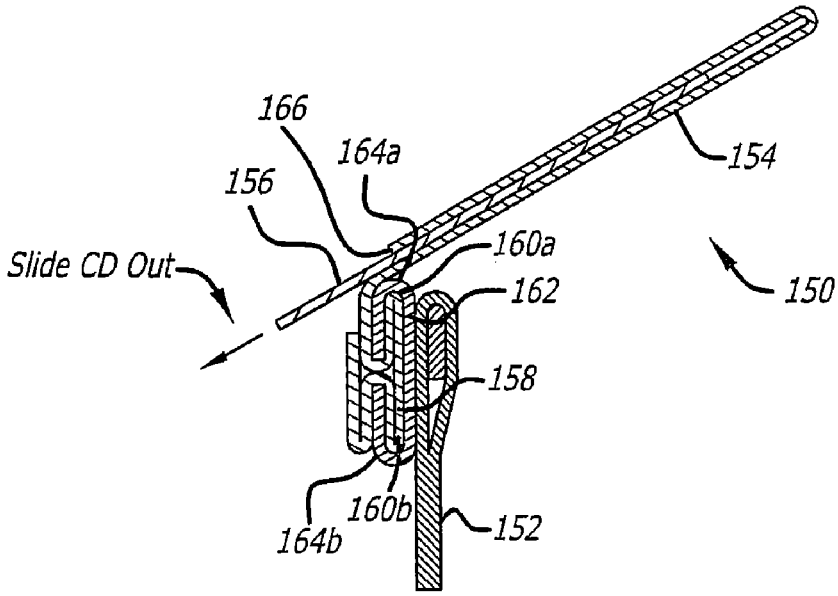
FIG. 23 is a side-view of a compact disk holder mounted to a rail of a file folder and rotated approximately two-hundred-twenty-five (225) degrees from a position substantially parallel to the file folder according to one embodiment of the invention.

FIG. 23 is a cross-section view of a compact disc holder 150 and a file folder 152 wherein the compact disc holder 150 has been rotated approximately two-hundred-twenty-five (225) degrees from a position substantially parallel to the file folder 152. Rotation of the compact disc holder 150 in this manner enables a compact disc to be inserted or removed from a pocket 154 of the compact disc holder 150 through an opening 166 provided at a top portion of the pocket 154. In a stored position as shown in FIG. 17, the opening 166 is preferably located behind a portion of the pocket 154. This reduces a likelihood of the compact disc 156 from accidentally being removed from the compact disc holder 150. As shown in FIG. 19, the compact disc holder 150 may include a male portion 158 that may be secured to a rail 162 of a file folder 152. The male portion 158 may include securing portions 160A, 160B. The securing portions 160A, 160B may be inserted into the rail 162 and secured by connecting the securing portions 160A, 160B with securing edges 164A, 164B of rail 162.

Figure 24:
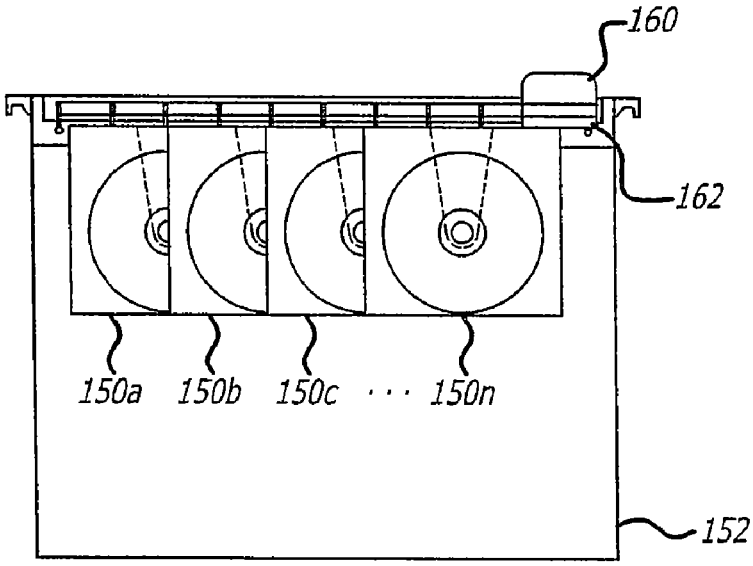
FIG. 24 is a front-view of a tab and a plurality of compact disk holders mounted on a rail of a file folder according to one embodiment of the invention.

FIG. 24 illustrates a file folder 152 having a rail 162 that supports multiple compact disc holders 150A-150N and a tab 160. The compact disc holders 150A-150N and the tab 160 may be attached to the rail 162 in any manner according to the invention. It is to be understood that the compact disc holders 150A-150N and tab 166 may be slidable along the rail 162. It is also to be understood that any number of compact disc holders 150A-150N and tabs 166 may be provided on the rail 162 and that the number is only limited by a length of the rail 162.

Figure 25:
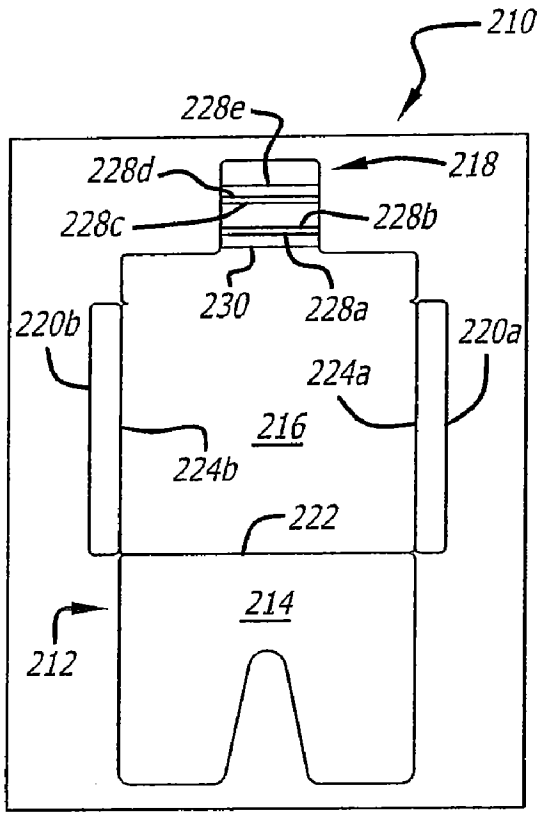
FIG. 25 is an illustration of a printable sheet having a die-cut compact disk holder according to one embodiment of the invention.

FIG. 25 illustrates a printable sheet 210 that includes a compact disc holder 212. The compact disc holder 212 may include a bottom portion 214, top portion 216, rail engagement member portion 218, and side portions 220A, 220B. The bottom portion 214 and the top portion 216 may be separated by a fold line 222. The side portions 220A, 220B may be separated from the top portion 216 along fold lines 224A, 224B, respectively. An outline of the compact disc holder 212 is preferably a full-cut tab outline through a top sheet of the printable sheet 210. This facilitates removal of the compact disc holder 212 from the printable sheet 210. The fold lines 222, 224A, and 224B, 230, 228*a*-228*e* are preferably half (½) depth score lines through a top sheet of the printable sheet 210. Score cuts 228*a* and 228*d* are cuts from the underside of the top sheet. The other cuts are cut from the top side. This facilitates folding of the compact disc holder 212 into a desired configuration. According to one embodiment, the bottom portion 214 is folded under the top portion 216 along the fold line 222. After folding the bottom portion 214 under the bottom portion 216, the side portions 220A, 220B may be folded on top of the bottom portion 214 along the fold lines 224A, 224B. The side portions 220A, 220B may be provided with a securing mechanism such as an adhesive that secures the side portions 220A, 220B to the bottom portion 214. This creates a pocket in which a compact disc or other item may be inserted.

The rail engagement member portion 218 may be provided with multiple fold lines 228A-228E. The fold lines 228A-228E may be used to create a male portion for inserting into a rail of a file folder. Preferably, the rail engagement member portion 218 is folded such that the male portion is created on a side of top portion 216 on which the bottom portion 214 has been folded. The rail engagement member portion 218 may also be provided with a fold line 230 that enables the compact disc holder 212 to be rotated approximately 225 degrees about a rail of a file folder to allow insertion and removal of a compact disc from the compact disc holder 212.

Figure 26:
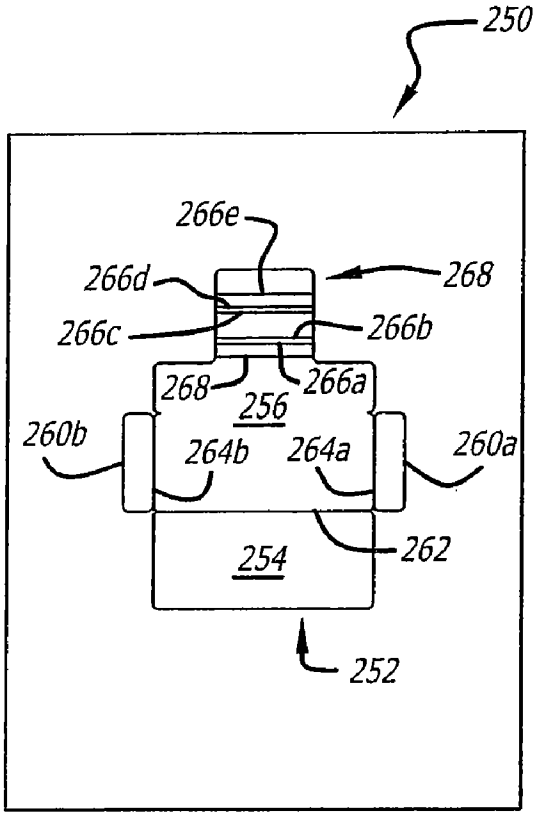
FIG. 26 is an illustration of a printable sheet having a die-cut business card holder according to one embodiment of the invention.
Figure 27:
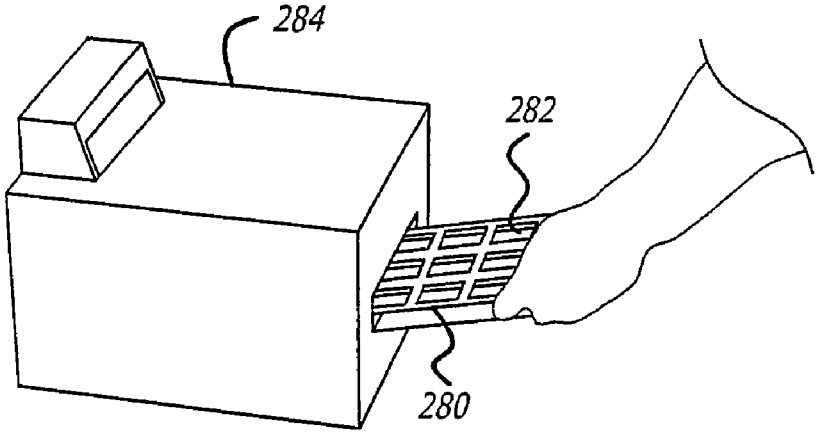
FIG. 27 is an illustration of a printable sheet having die-cut tabs being inserted into a standard inkjet or laser printer according to one embodiment of the invention.

FIG. 26 illustrates a printable sheet 250 that includes a business card holder 252. The business card holder 252 may include a bottom portion 254, top portion 256, rail engagement member portion 258, and side portions 260A, 260B. The bottom portion 254 and the top portion 256 may be separated by a fold line 262 that enables the bottom portion to be folded under top portion 256. The side portions 260A, 260B, may be located on two sides of the top portion 256 and separated by fold lines 264A, 264B. The rail engagement member portion 258 may include fold lines 266A-266E. The fold lines 266A-266E may be used to create a male portion for inserting into a rail of a file folder. The tab portion 258 may also include a fold line 268 that enables the business card holder to be rotated about a rail of a file folder for allowing insertion or removal of a business card from the business card holder 252. According to one embodiment of the invention, an outline of the business card holder 252 is provided with a full cut outline through the top sheet of the printable sheet 250. The fold lines 262, 264A, 264B, 266A-266E, and 268 are preferably half (½) depth score lines through the top sheet of the printable sheet 250. It is noted that 266*a* and 266*d* are score cuts from the bottom. All others are from the top FIG. 27 illustrates that a printable sheet 280 that includes one or more die-cut tabs, compact disc holders, business card holders, etc. may be inserted into a laser, ink jet, or other standard printer 284 for printing indicia on the die-cut tabs, compact disc holders, business card holders, etc. 282.

Figure 28:
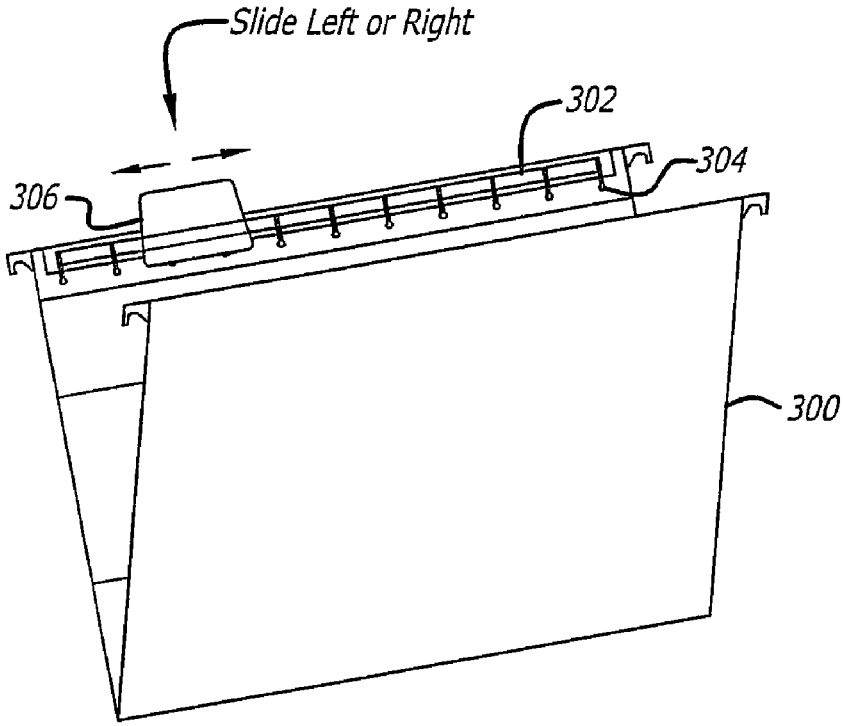
FIG. 28 is an illustration of a file folder with a rail that includes a slidable tab according to one embodiment of the invention.

FIG. 28 illustrates a hanging file folder 300 that includes a rail 302 affixed to the folder 300. The rail 302 may be mounted to the folder 300 using wings or flaps attached to the rail and inserted into standard graduated slots 304 provided along an edge of the folder 300 or by other means such as adhesive or glue. The rail 302 may be used to secure a tab 306 to the folder 300. The tab 306 may be mounted to the rail as discussed above and be slidable along the rail 302.

It is also noted that slidable accessories may be freely slidable, or that the sliding may be limited by friction between the mounting portion of the slidable accessory and the rail. The degree to which there is friction may be controlled, in part, by the relative sizing of the mounting mechanism and the rail.

While the specification describes particular embodiments of the present invention, those of ordinary skill can devise variations of the present invention without departing from the inventive concept. For example, various holders may be provided for mounting on a rail of a file folder, various materials may be used, various locations, sizes, and types of fold lines may be used, various types of rail configurations and methods of securing a tab or holder to a rail of a file folder may be used, etc. The invention is intended to be limited only by the claims below.

What is claimed is:

1. A method of assembling a sliding accessory system, comprising the steps of:

providing a sheet assembly for making an accessory that slidably engages with a rail of a support member, comprising a facesheet having a removable portion, the removable portion having a front side and a back side that is at least partially coated with adhesive, the removable portion having fold lines, the removable portion being foldable into an accessory with a rail engagement member, and a release liner backing the facesheet;

removing the removable portion from the sheet assembly;

folding the removable portion into an accessory; and mounting the accessory on the rail of the support member;

wherein the removable portion of the facesheet is for forming an index tab, the removable portion having a top panel, a bottom panel, a first engagement panel, a support panel, a second engagement panel, and an end panel.

2. A method as defined in claim 1, wherein the removable portion has partial-cut score lines on the front side and on the back side.

3. A method as defined in claim 1, wherein the back side of the removable portion is coated in a pattern with adhesive, with at least one area coated with adhesive and another area free of adhesive.

4. The method of claim 1, wherein:

the sheet assembly is a printable sheet assembly; and the removable portion having at least one printable area on the front side.

5. A method as defined in claim 4, wherein the at least one printable area comprises a coating that is receptive to at least one of inkjet ink and laser toner.

6. The method of claim 4, wherein the method further comprises the step of printing on the at least one printable area of the sheet assembly with at least one of a laser printer and an ink jet printer.

7. The method of claim 1, wherein the end panel and a portion of the bottom panel are coated with adhesive.

8. The method of claim 1, wherein the top panel is coated with adhesive in an area to adhere to the end panel, and in another area to adhere to a portion of the bottom panel.

9. The method of claim 1, wherein the adhesive is one of a pressure sensitive adhesive, a water-activatable adhesive, a heat-activatable adhesive, and a solvent-activatable adhesive.

10. A method of printing and assembling a sliding accessory system, comprising the steps of:

having a printable sheet assembly for making an accessory that engages with a rail of a support member, comprising a facesheet having a removable portion, the removable portion having a front side with at least one printable area and a back side that is at least partially coated with adhesive, the removable portion having fold lines, the removable portion being foldable into an accessory with a rail engagement member, and a release liner backing the facesheet;

printing on the at least one printable area of the sheet assembly with at least one of a laser printer and an ink jet printer;

after printing, removing the removable portion from the sheet assembly;

folding the removable portion into an accessory;

mounting the accessory on the rail of the support member; and after mounting the accessory, sliding the accessory along the rail;

wherein the removable portion of the facesheet is for forming an index tab, the removable portion having a top panel, a bottom panel, a first engagement panel, a support panel, a second engagement panel, and an end panel.

11. A method as defined in claim 10, wherein the end panel and a portion of the bottom panel are coated with adhesive.

12. A method as defined in claim 10, wherein the top panel is coated with adhesive in an area to adhere to the end panel, and in another area to adhere to a portion of the bottom panel.

13. A method as defined in claim 10, wherein the adhesive is one of a pressure sensitive adhesive, a water-activatable adhesive, a heat-activatable adhesive, and a solvent-activatable adhesive.

14. The method of claim 10, wherein the fold lines are partial-cut score lines on the front side and on the back side.

15. The method of claim 10, wherein the back side of the removable portion is coated in a pattern with adhesive, with at least one area coated with adhesive and another area free of adhesive.

16. The method of claim 10, wherein the removable portion is foldable into an index tab.

17. The method of claim 10, wherein the removable portion includes a coating that is receptive to at least one of inkjet ink and laser toner.

* * * * *